US006370702B1

(12) United States Patent
Iddings, Sr.

(10) Patent No.: US 6,370,702 B1
(45) Date of Patent: Apr. 16, 2002

(54) TOILET ENCLOSURE WITH VENTILATION SYSTEM

(76) Inventor: Harold E. Iddings, Sr., R.R.#1 Box 79-A, Benton, PA (US) 17814

( * ) Notice: Subject to any disclaimer, the term of this patent is extended or adjusted under 35 U.S.C. 154(b) by 0 days.

(21) Appl. No.: 09/670,034

(22) Filed: Sep. 26, 2000

(51) Int. Cl.[7] ..... E03D 9/052
(52) U.S. Cl. ..... 4/213
(58) Field of Search ..... 4/213

(56) References Cited

U.S. PATENT DOCUMENTS

| | | | | |
|---|---|---|---|---|
| 2,086,066 A | | 7/1937 | Churchill | 4/213 |
| 2,157,664 A | | 5/1939 | Hansen | 4/213 X |
| 2,183,897 A | * | 12/1939 | Stiller | 4/213 X |
| 2,326,957 A | | 8/1943 | Maguire | 4/213 X |
| 3,266,060 A | * | 8/1966 | Springer | 4/213 |
| 3,763,505 A | * | 10/1973 | Zimmerman | 4/213 X |
| 3,902,203 A | | 9/1975 | Poister et al. | 4/213 |
| 4,159,547 A | | 7/1979 | Blankenship | 4/111.1 |
| 4,922,557 A | | 5/1990 | Harding et al. | 4/347 X |
| 5,073,998 A | * | 12/1991 | Wood, Jr. et al. | 4/661 |
| 5,253,371 A | | 10/1993 | Slawinski | 4/213 |

* cited by examiner

*Primary Examiner*—Robert M. Fetsuga
(74) *Attorney, Agent, or Firm*—David A. Tamburro

(57) ABSTRACT

An enclosure for a standard toilet which is quickly and easily placed around the toilet. The enclosure includes a built-in ventilation system for exhausting foul air from the toilet bowl without necessitating any structural modification of the standard toilet.

14 Claims, 3 Drawing Sheets

TOILET ENCLOSURE WITH VENTILATION SYSTEM

BACKGROUND OF THE INVENTION

This invention relates generally to a ventilation system for toilets and more particularly to an enclosure which substantially surrounds the toilet bowl and exhausts foul air and odors from the bowl during use.

In the past, various systems have been proposed for ventilating foul air and odors from the bowl of a standard toilet, but those systems ordinarily require substantial structural modification of the seat or bowl of the toilet and installation of separate blower devices and ventilating ducts, often within the wall structure behind the toilet. Because of the complexity of these systems and the unsightly appearance resulting from their installation, to my knowledge none of those systems has been successfully commercialized.

Thus, a need remains for a ventilation system for a standard toilet which functions well, yet requires no substantial modification of the toilet. My invention, as described below, was developed to satisfy that need.

SUMMARY OF THE INVENTION

Accordingly, the primary object of my invention is to provide a novel enclosure for a toilet which substantially surrounds at least the toilet bowl and includes a ventilation system for exhausting foul odors from the bowl during use.

The objectives of the invention are accomplished by providing a self supporting decorative enclosure which includes a front seating section that substantially surrounds the bowl and a rear upright section that substantially encloses the tank of the toilet, the rear of the enclosure being open so that it may conveniently and easily slid from the front to the back of the toilet to enclose the front and sides of the toilet. An exhaust system is mounted within the enclosure and is activated by downward pressure on a seat placed on top of the front section of the enclosure to automatically draw foul air from the bowl of toilet. The air may be exhausted back into the room by way of an odor removing filter. The enclosure may be constructed in any decorative color and configuration and is readily placed around a standard toilet with virtually no modification of that standard toilet.

In operation, when a person sits on the seat of the front section, a pressure sensitive switch is activated to start an exhaust fan which may be vented through a filter on the side of the enclosure or may be directly vented to an area outside the room by way of suitable ducting. When the person rises from the seat, the exhaust fan continues to run for about one minute after the toilet is flushed to prevent the foul air from getting into the room.

These and other objectives will become apparent from reading the following detailed description of the invention wherein reference is made to the accompanying drawings.

DETAILED DESCRIPTION OF THE INVENTION

Figure 1:
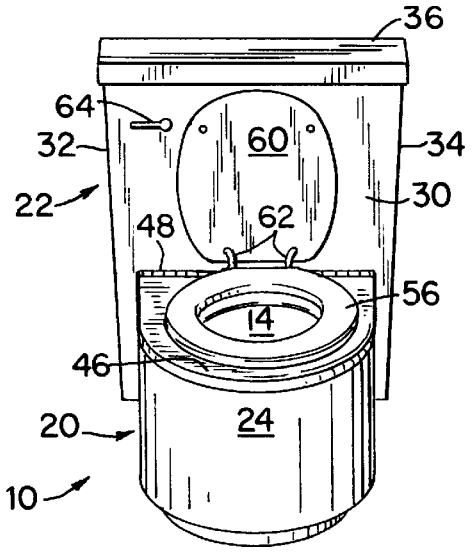
FIG. 1 is a front perspective view illustrating the novel enclosure of the invention mounted in place around a standard toilet.
Figure 2:
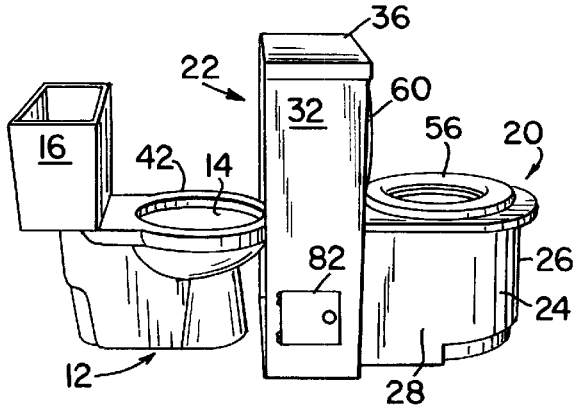
FIG. 2 is a side perspective view illustrating the enclosure placed in front of the toilet, ready for sliding insertion of the enclosure to surround the toilet.
Figure 3:
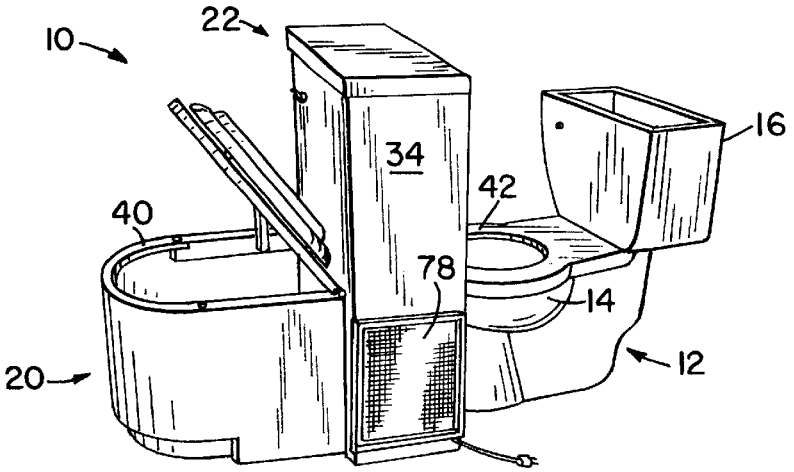
FIG. 3 is a right side perspective view of the enclosure similar to FIG. 2, illustrating the odor removing filter by which the air may be vented directly into a room.
Figure 6:
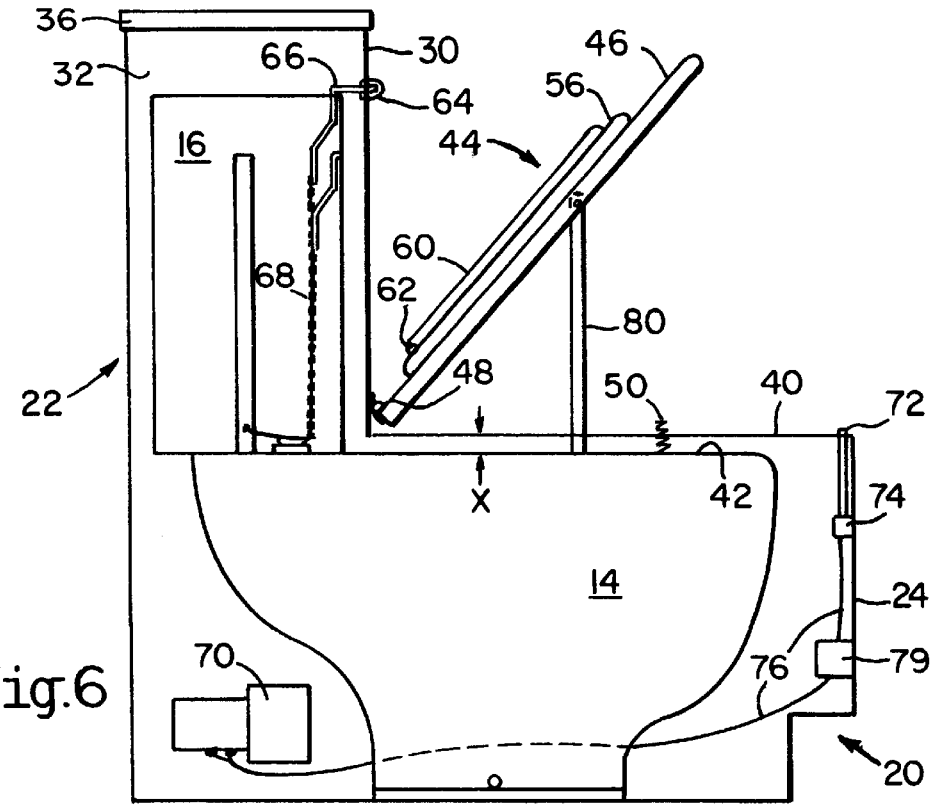
FIG. 6 is a left side schematic view illustrating the relationship of the enclosure as it surrounds the front and sides of a standard toilet bowl and tank.
Figure 7:
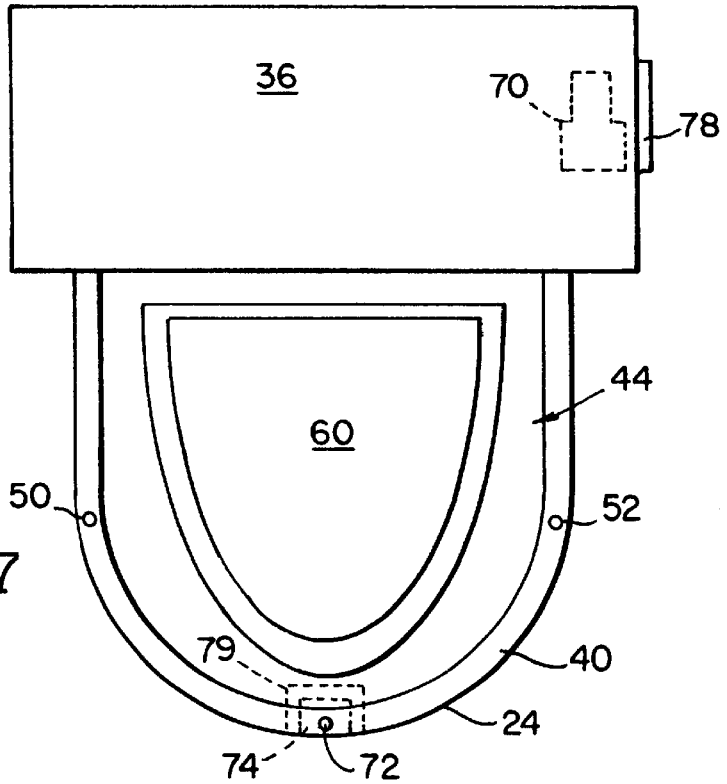
FIG. 7 is a top schematic view illustrating the enclosure in place around the toilet bowl and tank.

Referring now to the drawings, the novel enclosure 10 of the invention is shown for use with a standard household toilet 12 having a horizontal bowl 14 open at the top and an upright water tank 16 mounted on the rear of the bowl. The enclosure 10 includes a front hollow seating section 20 attached to a rear upright hollow section 22, both open at the back and sized and configured to slip around the toilet bowl 14 and water tank 16 when the enclosure 10 is slid rearwardly from the position illustrated in FIGS. 2 and 3 to the closely enclosing operative position around toilet 12 as illustrated in FIGS. 1 and 6. As shown in FIGS. 2 and 3, the toilet seat normally associated with bowl 14, the cover normally placed on top of tank 16, and the flush handle on the front of the tank are removed from toilet 12 before enclosure 10 is slid into the toilet surrounding position of FIG. 1.

As illustrated in FIG. 1, the enclosure 10 can be constructed in many different designs to overcome the rather unseemly appearance of a standard toilet in a bathroom and to enhance the overall environment of the room, with the enclosure 10 taking on the aesthetic appearance of a nice piece of furniture.

Figure 4:
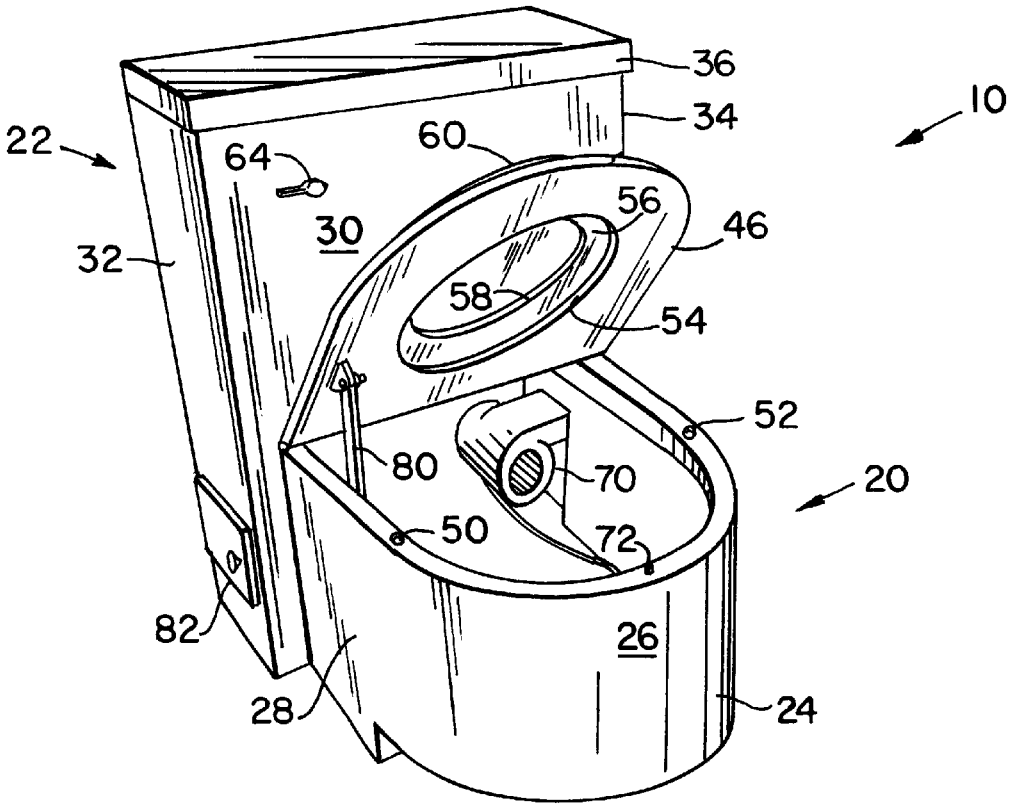
FIG. 4 is a front perspective view of the enclosure, with the seat of the enclosure raised and illustrating the exhaust blower mounted directly on the side wall of the enclosure.
Figure 5:
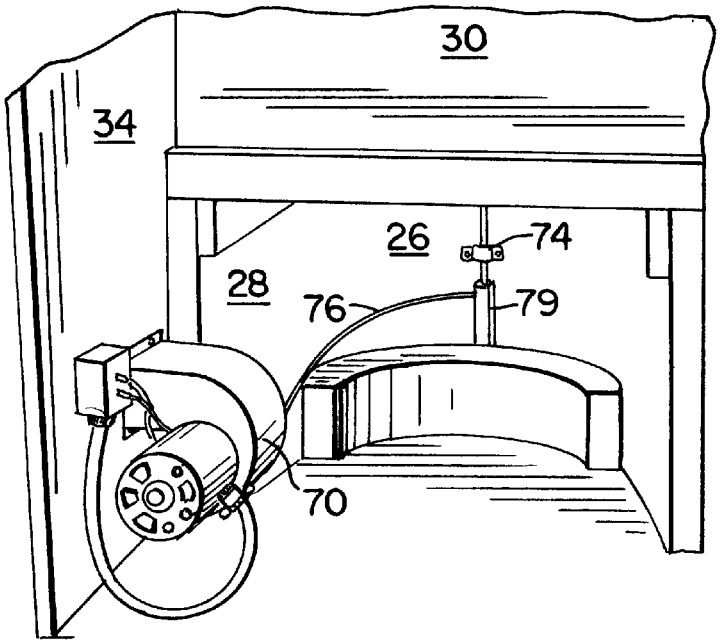
FIG. 5 is a rear perspective view of the enclosure.

The front section 20 is formed by an upright wall 24 having a curved front portion 26 joining straight side portions 28 which define a hollow chamber which surrounds the front portion of toilet bowl 14. Upright section 22 includes a front panel 30 and side panels 32 and 34 and a removable top 36. As shown in FIGS. 4 and 5, enclosure sections 20 and 22 are open at the rear to enable the enclosure to be slid into place around toilet 12 as shown in FIG. 1. When the enclosure is in place around the toilet, the upper edge 40 of wall 24 is a distance X (about one-quarter inch) higher than the upper edge 42 of toilet bowl 14 (see FIG. 6) to provide a space for air flow from bowl 14 when the exhaust system is activated.

As mentioned previously, before enclosure 10 is put in place around toilet 12, the normal toilet seat and lid are removed from bowl 14, the cover is removed from tank 16 and the standard flush handle is removed from the front of tank 16.

Front section 20 is provided with a cover/seat means 44 that includes a first cover member 46 pivotally connected at 48 to wall 30 and, in its down position, rests on a pair of springs 50 and 52 in overlying relationship with and slightly above upper edge 40 of wall 24. Member 46 has a central opening 54 which overlies the top opening in toilet bowl 14. A seat 56 is fixed on top of member 46 and has a central opening 58 overlying opening 54 and a solid lid 60 is pivotally attached at 62 to seat 56 to cover openings 54 and 48 in the usual manner.

Section 22 is provided with a flush handle 64 connected to a tank actuator arm 66 which will extend downwardly into the open upper end of water tank 16 and be connected to the conventional actuating chain 68 within the tank.

The ventilation system for removing foul air from bowl 14 is integrally mounted within enclosure 10. The system includes a blower 70 mounted on the lower end of side wall 34 of section 22 and is positioned and sized so that it will clear the base portion of toilet 12 as the enclosure 10 is pushed into place from the front to the rear of the toilet. To actuate the blower a slideable activation rod 72 is mounted at the front of wall 24, the upper end of rod 72 extending above the upper edge 40 of wall 24 (see FIG. 6). As mentioned already, when the seat member 46 and seat 56 are in a normal down position and no person is seated on seat 56, member 46 is supported on springs 50 and spaced above upper edge 40 out of contact with rod 72. When a person sits on seat 56, member 46 is pushed downwardly into engagement with the upper end of rod 72 to close a pressure sensitive switch 74 which provides electrical current via wire 76 to energize blower 70 and thereby draw foul air from bowl 14 through the space provided between the upper edge 40 of wall 24 and the upper edge 42 of bowl 14 into the chamber defined by section 20 around bowl 14. Blower 70 sucks the air from that chamber and then exhausts that air through an odor removing filter 78 mounted at the bottom of side panel 34 (FIG. 3) back into the room. Alternatively, the exhaust outlet from blower 70 may be connected to a separate ventilation duct leading to the outside atmosphere. Blower 70 continues to run as long as the person remains seated on seat 56. When that person removes himself from that seat, springs 50 push the seat assembly 46 upwardly so that member 46 no longer engages the upper end of rod 72, thus opening the pressure sensitive switch 66. However, a time delay switch 79 remains closed to continue to supply current to blower 70 for a period of time, for example about one minute, after the toilet is flushed and fresh water is again furnished to bowl 14. When that time period expires, the time delay switch opens and blower 70 is shut off.

As shown in FIGS. 4 and 6, a support rod 80 is pivotally connected to the underside of member 46 for movement between a vertical upright position in which it supports the assembly 44 in an opened raised positioned to permit cleaning of the toilet bowl 14 and a folded horizontal position in which the assembly is lowered to the seating position illustrated in FIGS. 1 and 2. Also, mounted on the side panel 32 of rear section 22 is an access door 82 which is removable to enable a person to reach the water shut off valve of toilet 12, if necessary.

From the description hereinabove, it is readily apparent that the enclosure 10 overcomes the problems associated with prior ventilation systems for toilets and provides a unit with a built in ventilation system which can be quickly and easily installed in substantially surrounding relationship over a conventional toilet. No structural modifications need to be made to the toilet to accommodate the enclosure or the ventilation system, only the conventional toilet seat, tank cover, and flush handle need be removed. Enclosure 10 may take the shape and configuration of various decorative designs and may be colored to blend in with the design scheme of a bathroom. The ventilation system is prefabricated within the enclosure and is ready for operation as soon as the enclosure is placed around the standard toilet.

While the enclosure 10 is illustrated above for use in combination with a standard bathroom toilet 12 having both a bowl 14 and an upright water tank 16, it is understood that the enclosure may also be adapted for use with a commercial type toilet which has no water tank 16, but includes only a valve at the rear of the toilet for furnishing water directly to bowl 14.

The invention may be embodied in other specific forms without departing from the spirit or essential characteristics thereof the present embodiments are therefore to be considered in all respects illustrative and not restrictive, the scope of the invention being indicated by the appended claims rather than by the foregoing description, and all changes which come within the meaning and range of equivalency of the claims are therefore intended to be embraced therein.

What is claimed is:

1. In combination with a self supporting toilet including a toilet bowl having a first upper edge defining a top opening, an enclosure substantially surrounding said bowl and defining a chamber therewith, said enclosure having a second upper edge spaced above said first upper edge of said bowl, seat means pivotally connected to said enclosure and being supporting on said second upper edge when a person is seated thereon, said seat means having an opening overlying said top opening of said bowl, a ventilating system mounted on said enclosure and including a blower communicating with said chamber and a switch responsive to a person sitting on said seat means to energize said blower to draw foul air from said bowl through the space between said first and second upper edges into said chamber through said blower and out of said enclosure.

2. The combination of claim 1, laid ventilating system including a time delay switch causing said blower to continue to operate for a period of time after a person gets off said seat means.

3. The combination of claim 2, said ventilating system including a filter on said enclosure for filtering the exhaust air from said blower.

4. The combination of claim 1, said ventilating system including a filter on said enclosure for filtering the exhaust air from said blower.

5. The combination of claim 1, said toilet having a water tank connected to the back of said bowl said enclosure having an upright section substantially surrounding said water tank.

6. The combination of claim 5, said enclosure comprising a flush actuator mounted on said upright section and adapted to be connected to flush mechanism in said water tank.

7. For use with a self supporting toilet bowl having a first upper edge defining a top opening, an enclosure adapted to substantially surround said bowl and define a chamber therewith, said enclosure having a second upper edge adapted to be spaced above said first upper edge of said bowl, seat means pivotally connected to said enclosure and being supported on said second upper edge when a person is seated thereon, said seat means having an opening adapted to overly said top opening of said bowl, a ventilating system mounted on said enclosure and including a blower communicating with said chamber and a switch responsive to a person sitting on said seat means to energize said blower to draw foul air from said bowl through the space between said first and second upper edges into said chamber through said blower and out of said enclosure.

8. The enclosure of claim 7, said ventilating system including a time delay switch causing said blower to continue to operate for a period of time after a person gets off said seat means.

9. The enclosure of claim 8, said ventilating system including a filter for filtering the exhaust air from said blower.

10. The enclosure of claim 7, said ventilating system including a filter for filtering the exhaust air from said blower.

11. The enclosure of claim 7, further comprising an upright section adapted to substantially surround a water tank connected to the toilet bowl.

12. The enclosure of claim 11, comprising a flush actuator mounted on said upright section and adapted to be connected to flush mechanism in the water tank.

13. The combination of claim 1, further comprising a spring urging said seat means upwardly off said second upper edge when no person is seated on said seat means, an actuator rod mounted at the front of said enclosure and having an upper end extending above said first upper edge, whereby when a person sits on said seat means said seat means is lowered into engagement with said upper end of said rod to cause said rod to actuate said switch.

14. The enclosure of claim 7, further comprising a spring urging said seat means upwardly off said second upper edge when no person is seated on said seat means, an actuator rod mounted at the front of said enclosure and having an upper end extending above said first upper edge, whereby when a person sits on said seat means said seat means is lowered into engagement with said upper end of said rod to cause said rod to actuate said switch.

* * * * *